US010392164B2

(12) United States Patent
Uno et al.

(10) Patent No.: US 10,392,164 B2
(45) Date of Patent: Aug. 27, 2019

(54) TUBE SQUEEZE DEVICE

(71) Applicant: NAKASU ELECTRIC CO.,LTD., Gifu (JP)

(72) Inventors: Tsuyoshi Uno, Gifu (JP); Yasuyuki Miyanaga, Gifu (JP)

(73) Assignee: NAKASU ELECTRIC CO., LTD., Gifu (JP)

( * ) Notice: Subject to any disclaimer, the term of this patent is extended or adjusted under 35 U.S.C. 154(b) by 0 days.

(21) Appl. No.: 15/574,829

(22) PCT Filed: Nov. 17, 2016

(86) PCT No.: PCT/JP2016/084042

§ 371 (c)(1),
(2) Date: Apr. 12, 2018

(87) PCT Pub. No.: WO2017/086371

PCT Pub. Date: May 26, 2017

(65) Prior Publication Data

US 2018/0215511 A1 Aug. 2, 2018

(30) Foreign Application Priority Data

Nov. 19, 2015 (JP) ..... 2015-226566

(51) Int. Cl.
*B65D 35/28* (2006.01)

(52) U.S. Cl.
CPC ..... *B65D 35/285* (2013.01)

(58) Field of Classification Search
CPC ..... B65D 35/285
See application file for complete search history.

(56) References Cited

U.S. PATENT DOCUMENTS 2,064,357 A * 12/1936 Ritterbusch ..... B65D 35/285 222/102
2,066,245 A * 12/1936 Bauman ..... B65D 35/285 100/902
2,357,351 A * 9/1944 Oliver ..... B65D 35/285 222/102

(Continued)

FOREIGN PATENT DOCUMENTS

GB 1002315 A 8/1965
JP 06050354 Y2 12/1994

(Continued)

*Primary Examiner* — David P Angwin
*Assistant Examiner* — Bob Zadeh
(74) *Attorney, Agent, or Firm* — Blueshift IP, LLC; Robert Plotkin

(57) ABSTRACT

A tube squeeze device is provided with: a body; a handle extending from the body; an operation lever axially supported by the body via a rotation shaft such that the operation lever is disposed facing the handle, the operation lever being capable of turning in two directions within a prescribed range of movement; a first gear axially supported by the body via the rotation shaft so as to be capable of rotating; a one-way clutch for linking the operation lever and the first gear; a second gear axially supported by the body; a main roller joined with the second gear so as to rotate synchronously with the second gear; and an auxiliary roller for squeezing a tube T together with the main roller.

7 Claims, 10 Drawing Sheets

(56) References Cited

U.S. PATENT DOCUMENTS

| | | | | | |
|---|---|---|---|---|---|
| 2,566,503 | A * | 9/1951 | Snyder | B65D 35/285 222/102 |
| 3,006,508 | A | 10/1961 | Preidel | |
| 3,291,344 | A * | 12/1966 | Meyer | B65D 35/285 222/98 |
| 2018/0215511 | A1 * | 8/2018 | Uno | B65D 35/285 |

FOREIGN PATENT DOCUMENTS

| | | | |
|---|---|---|---|
| JP | 3017761 | U | 11/1995 |
| JP | 2007230646 | | 9/2007 |
| JP | 2008213941 | A | 9/2008 |
| JP | 2013169973 | A | 9/2013 |

* cited by examiner (a)
(b)
(c)
100
101
102
103
104
105
108
109
110
111
113
115
116
117
101a
A
B (a)

(b)

TUBE SQUEEZE DEVICE

TECHNICAL FIELD

The present invention relates to a tube squeeze device for squeezing out the contents of a tube.

BACKGROUND ART

Various devices for squeezing out contents of a tube so that nothing remains in the tube have been proposed.

For example, Patent Document 1 discloses a tool for squeezing out the contents of a tube, including a roller (1) for pressing the tube to squeeze out the contents of the tube, a fan-shaped column arc face (8) for receiving pressure of the roller (1), and a handle (10) that axially supports the roller (1) and can be operated so that the roller (1) travels along the fan-shaped column arc face (8). In addition, a tube fixing slit (6) and a tube fixing hole (7) for fixing the bottom part (12) of the tube are provided on the fan-shaped column arc face (8) side. By fixing the bottom part (12) of the tube on the fan-shaped column arc face (8), pinching the tube (11) between the roller (1) and the fan-shaped column arc face (8), and pulling down the handle (10), the contents of the tube can be squeezed out through the tube head (13). (See FIG. 3 of Patent Document 1). Please note that the numerals in brackets ( ) above are the numerals as used in Patent Document 1.

RELATED ART DOCUMENTS

Patent Documents

Patent Document 1: Japanese Unexamined Patent Application Publication No. 2007-230646.

SUMMARY OF THE INVENTION

Problem to be Solved by the Invention

However, in a conventional tube squeeze device such as the one proposed in Patent Document 1, the contents of the tube were squeezed out by setting the bottom part of the tube in a tube fixing hole and causing the roller to move downward relative to the fan-shaped column arc face. In such a device, the fan-shaped column arc face needed to be made at least longer than the length of the tube body. It was therefore difficult to squeeze tubes that were longer than the fan-shaped column arc face, and the device itself thus had to be made very large to accommodate a wide variety of tubes. There is thus a need to develop a tube squeeze device that is compact and easy to operate.

The present invention was made in order to solve the aforementioned problem, and an object thereof is to provide a tube squeeze device that is compact and easy to operate.

Means for Solving the Problem

According to an embodiment of the present invention, the tube squeeze device is a tube squeeze device for squeezing contents out of a tube, the tube squeeze device including:

a body;

a handle extending from the body;

an operation lever axially supported by the body via a rotation shaft such that the operation lever is disposed facing the handle, the operation lever being capable of turning in two directions within a prescribed range of movement;

a first gear axially supported by the body via the rotation shaft so as to be capable of rotating;

a one-way clutch for linking the operation lever and the first gear such that the first gear is caused to rotate in a forward direction when the operation lever is turned in the forward direction and such that the first gear is not caused to rotate when the operation lever is turned in a reverse direction;

a second gear axially supported by the body so as to be capable of rotating and so as to mesh with the first gear;

a main roller joined with the second gear so as to rotate synchronously with the second gear; and an auxiliary roller that follows the rotation of the main roller and squeezes a tube together with the main roller, wherein the rotation shaft is movably supported by an elongate hole provided in the body, whereby the rotation shaft is movable along a longitudinal axis of the elongate hole from a meshing position in which the first gear and the second gear mesh with each other to an idle position in which the first gear and the second gear are separate from each other, and wherein when the operation lever turns in the forward direction in a state where the rotation of the main roller in the forward direction is restricted, the rotation shaft moves from the meshing position to the idle position, such that the first gear idles relative to the second gear.

According to a further embodiment of the present invention, the tube squeeze device is characterized in that the main roller and the auxiliary roller are disposed at a front end of the body, the handle extends downward at a rear end of the body, and the operation lever turns in the forward direction so as to approach the handle.

According to a further embodiment of the present invention, the tube squeeze device is characterized in that the longitudinal axis of the elongate hole is inclined diagonally backward and upward at a prescribed angle of inclination with respect to a straight line connecting the rotation shaft and a central axis of the second gear in the meshing position, wherein the angle of inclination is within a range of 45 to 85 degrees.

According to a further embodiment of the present invention, the tube squeeze device is characterized in that the angle of inclination is 75 degrees.

According to a further embodiment of the present invention, the tube squeeze device is characterized in that a tube holding groove for insertion of a bottom of the tube is formed in an outer surface of the main roller, the tube holding groove being open diagonally forward and upward when the tube holding groove has moved to a foremost surface.

According to a further embodiment of the present invention, the tube squeeze device further includes a flexible body that urges the operation lever away from the handle, and is characterized in that the rotation shaft is indirectly urged to the meshing position by the flexible body.

According to a further embodiment of the present invention, the tube squeeze device further includes a third gear axially supported by the body so as to be capable of rotating and so as to mesh with the second gear, and is characterized in that the auxiliary roller is joined to the third gear so as to rotate synchronously with the third gear.

EFFECTS OF THE INVENTION

According to an embodiment of the present invention, a turning operation of the operation lever in both directions causes the first gear to rotate only in the forward direction due to the one-way clutch, whereby the main roller rotates only in one direction, such that the tube can be fed between the main roller and the auxiliary roller without being retracted. The distance through which the tube is fed by the main and auxiliary rollers is determined by the distance and number of times the operation lever turns in the forward direction. For example, in a case where a long tube is being squeezed, multiple reciprocal movements of the operation lever ensure that all of the tube contents can be squeezed out. The tube squeeze device according to the present invention can thus be of a compact configuration, regardless of the length of the tube. Meanwhile, it is possible to make fine adjustments to the quantity of tube contents to be squeezed out by stopping turning of the operation lever at a predetermined position within the turning range, so as to define the distance through which the tube is fed. In other words, the simple action of a user holding the handle and turning the operation lever in both directions allows for a desired quantity of contents to be squeezed out regardless of the length of the tube. Accordingly, the tube squeeze device according to the present invention may be of a compact configuration, and is easy to operate.

According to a further embodiment of the present invention, in addition to the aforementioned effect, the first gear idles relative to the second gear when the operation lever is turned in the forward direction in a state where forward rotation of the main roller is restricted, whereby rotation of the main roller can be stopped. For example, when the tube has been fed between the main and auxiliary rollers up to the tube shoulder and the tube is locked by the main and auxiliary rollers (in other words when the tube is wedged between the rollers), any further rotation of the rollers caused by a forward turning operation of the operation lever is prevented. As such, even if the operation lever is operated excessively, the idling of the operation lever itself can prevent the first and second gears and the main roller from forcibly rotating and subjecting the components to excessive stress or damaging the tube.

MODE FOR CARRYING OUT THE INVENTION

Figure 1:
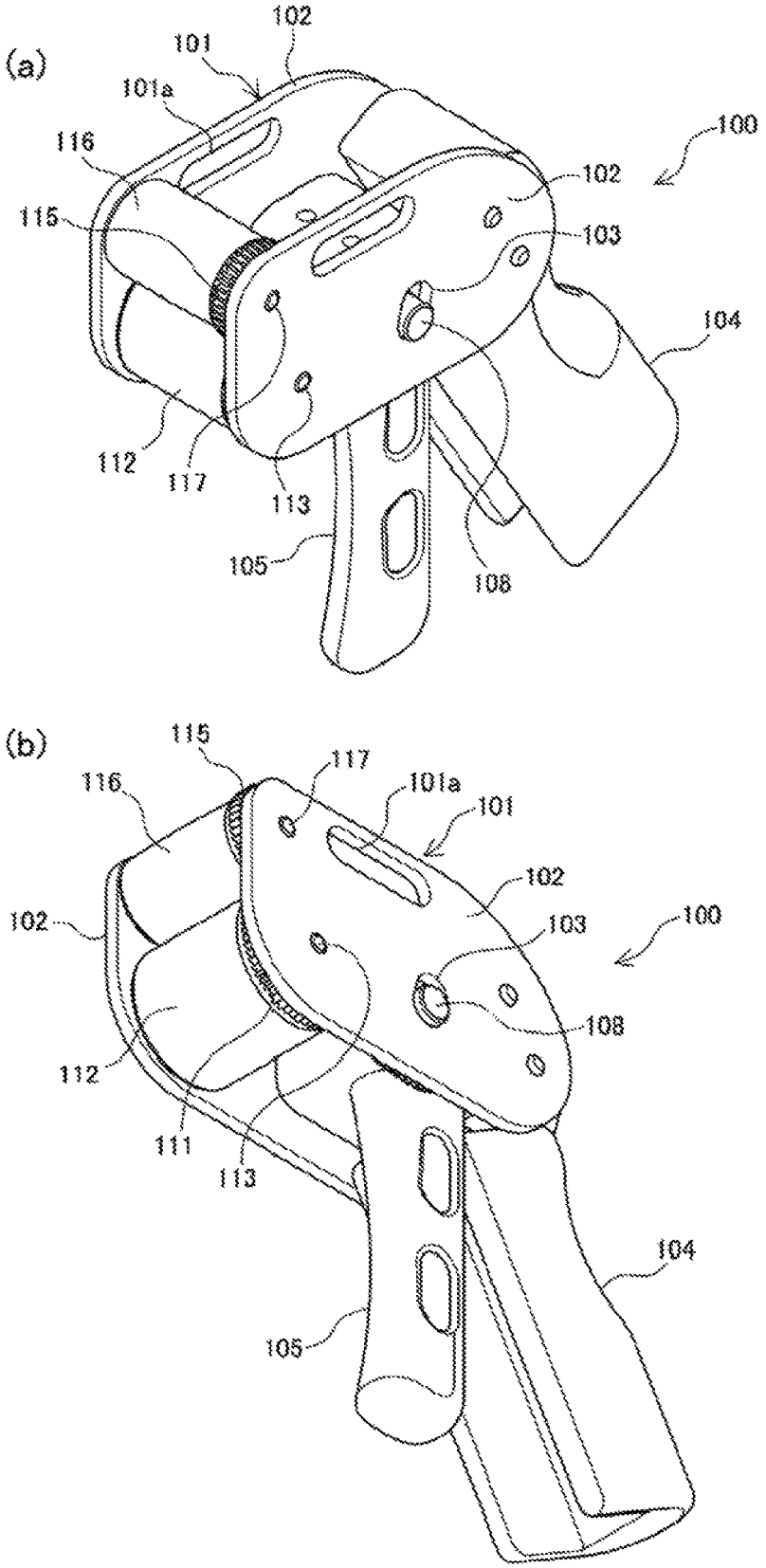
FIG. 1 shows a tube squeeze device according to an embodiment of the present invention, where (a) is a perspective view seen from above, and (b) is a perspective view seen from below.

An embodiment of the present invention is described below with reference to the drawings. It should be noted that the configurations shown in the drawings referred to in the following description are general or schematic illustrations for describing preferable configurations and dimensions, and that these dimensions do not necessarily match actual dimensions. In other words, the present invention is not limited to the dimensions shown in the drawings. The parts of a tube T are herein referred to as bottom T1, body T2, shoulder T3, and head T4. In addition, an operation of all elements in a direction for squeezing the tube T is referred to as the forward direction, and an operation in the opposite direction is referred to as the reverse direction.

Figure 2:
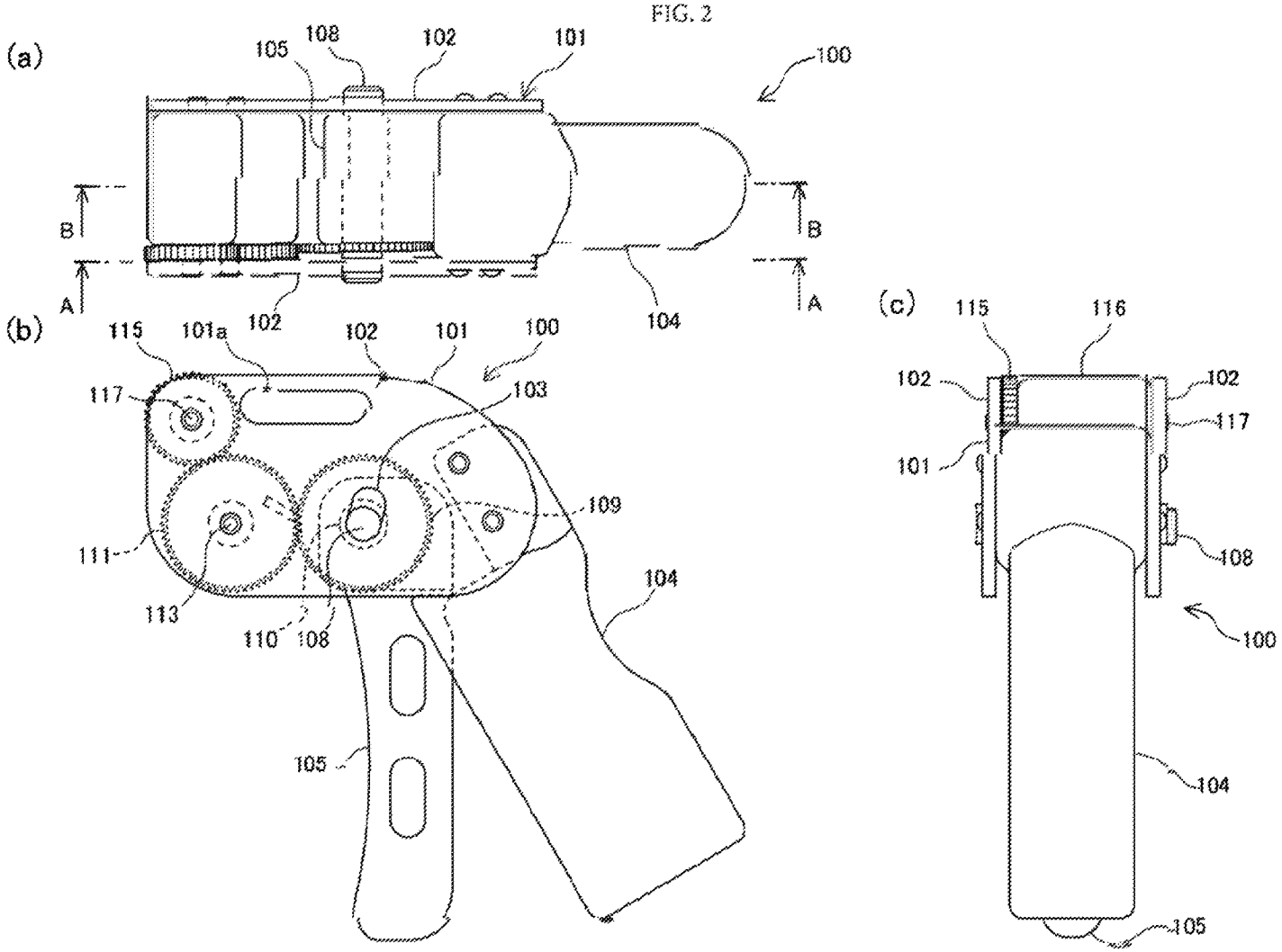
FIG. 2 shows the tube squeeze device of FIG. 1, where (a) is a side view, (b) is a plan view, and (c) is a front view.

The tube squeeze device 100 according to the present embodiment is used to flatten a tube containing for example a medicament to squeeze the contents out. FIG. 1 shows perspective views of the tube squeeze device 100 according to an embodiment of the present invention, respectively from above and below. FIGS. 2 (*a*), (*b*), and (*c*) respectively show a side view, a plan view, and a front view of the tube squeeze device 100.

As shown in FIGS. 1 and 2, the tube squeeze device 100 according to the present embodiment includes a body 101 consisting of a pair of side plates 102, a handle 104 extending from the body 101, and an operation lever 105 axially supported by the body 101 via a rotation shaft 108 such that the operation lever 105 is disposed facing the handle 104, the operation lever 105 being capable of turning in two directions within a prescribed range of movement.

The pair of side plates 102 have approximately rectangular shapes with rounded corners as seen from the side, and are configured to support the components on the inner sides thereof. An elongate hole 103 is bored approximately in the center of each side plate 102, and support holes 101*b* and 101*c* for respectively supporting the main roller 112 and auxiliary roller 116 are bored forward of the elongate hole 103. A hanging hole 101*a* for hanging the tube squeeze device 100 by a strap or hook is bored above the elongate hole 103. The handle 104 is fixed between the pair of side plates 102 such that the handle 104 extends downwardly at the rear end of the body 101. The handle 104 extends diagonally rearward and downward from the side plates 102, such that the handle 104 and the side plates 102 together form a deformed "v" shape, and the operation lever 105 extends approximately vertically downward from the side plates 102. In other words, the handle 104 and the operation lever 105 are disposed such that their lower ends are separate from each other. Further, between the handle 104 and the operation lever 105 there is interposed a spring 107, which urges the operation lever 105 forward (away from the handle 104). The operation lever 105 is capable of turning rearward from its forwardly-urged original position to approach the handle 104 until the spring 107 is almost completely compressed. In the present embodiment, the range of movement of the operation lever 105 from its original position is about 45 degrees, but this range may be set as desired.

Figure 3:
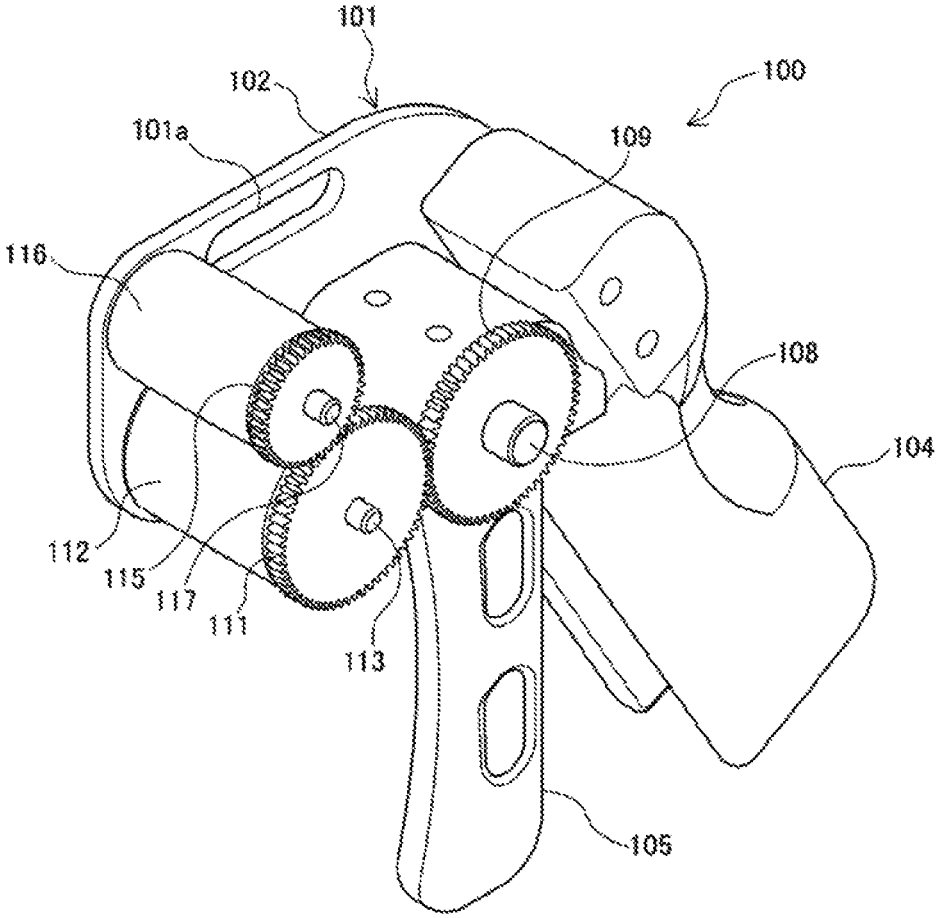
FIG. 3 is a perspective view of the tube squeeze device of FIG. 1 where one side plate is transparent.
Figure 4:
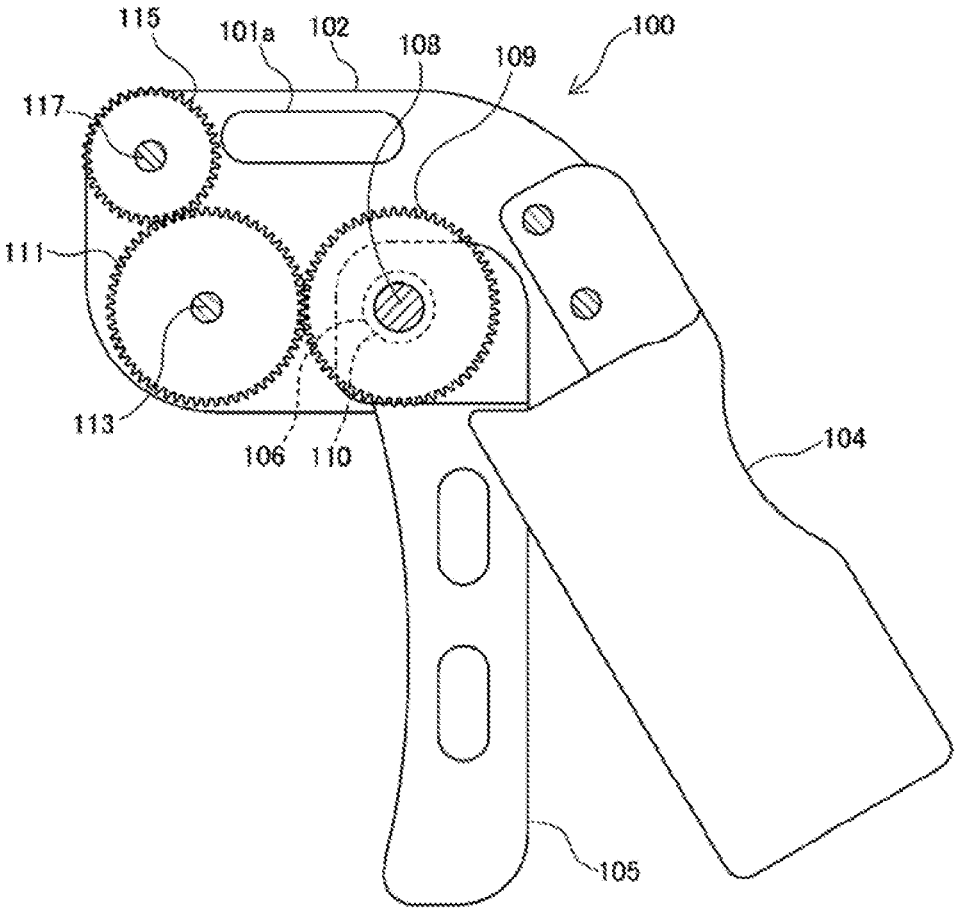
FIG. 4 is a cross-sectional view taken along line A-A in FIG. 2 (*b*).
Figure 5:
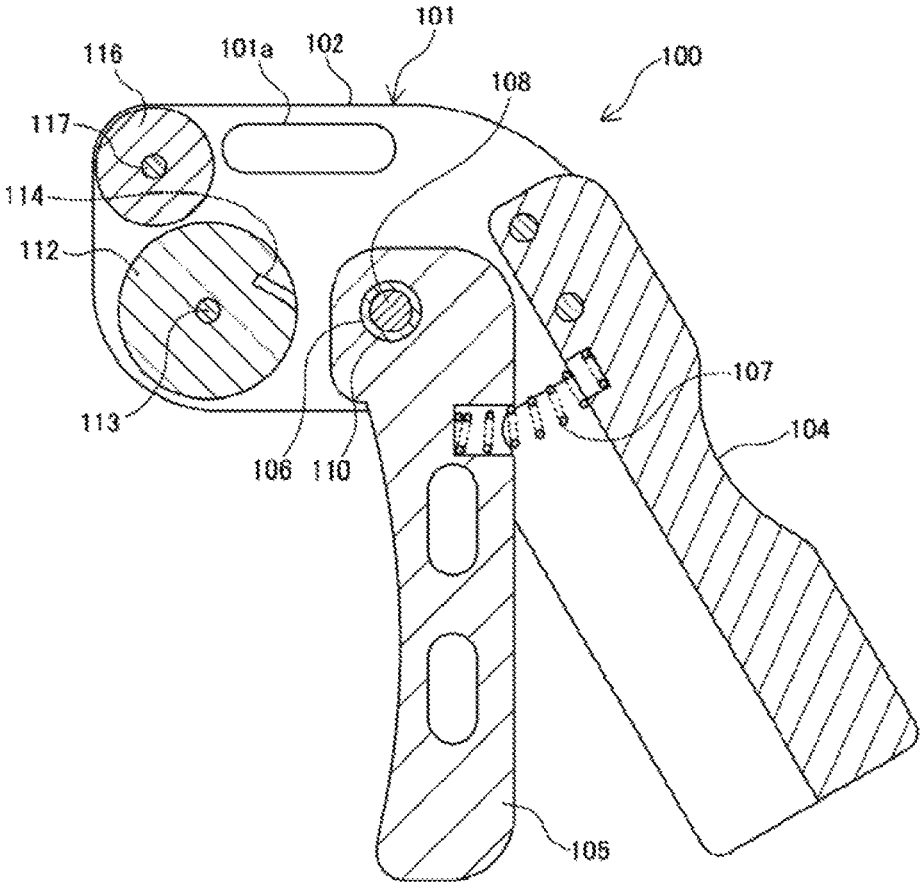
FIG. 5 is a cross-sectional view taken along line B-B in FIG. 2 (*b*).
Figure 6:
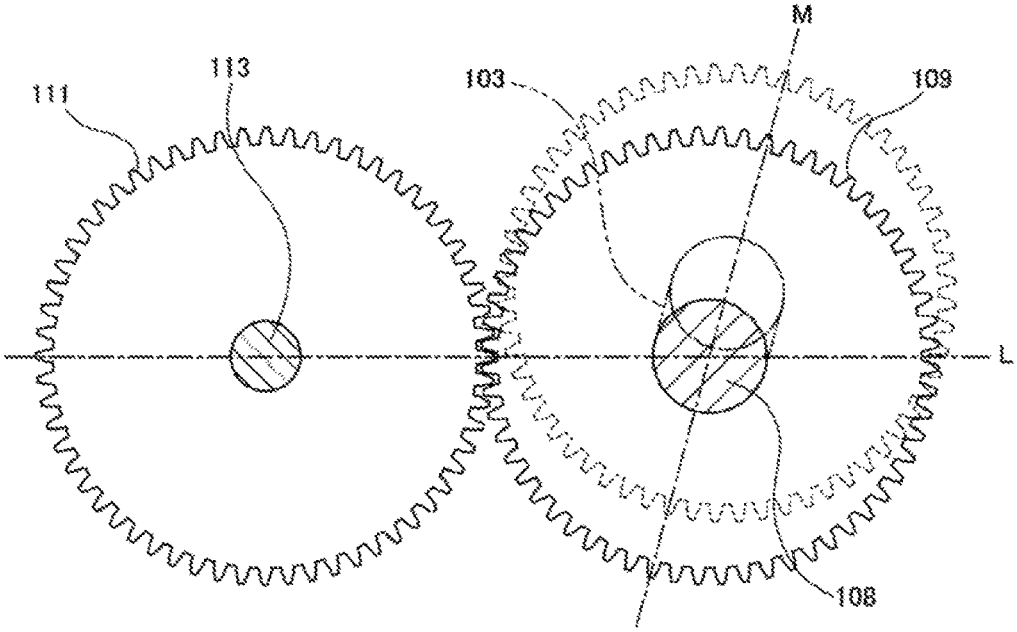
FIG. 6 is a partial enlarged view of FIG. 4.
Figure 7:
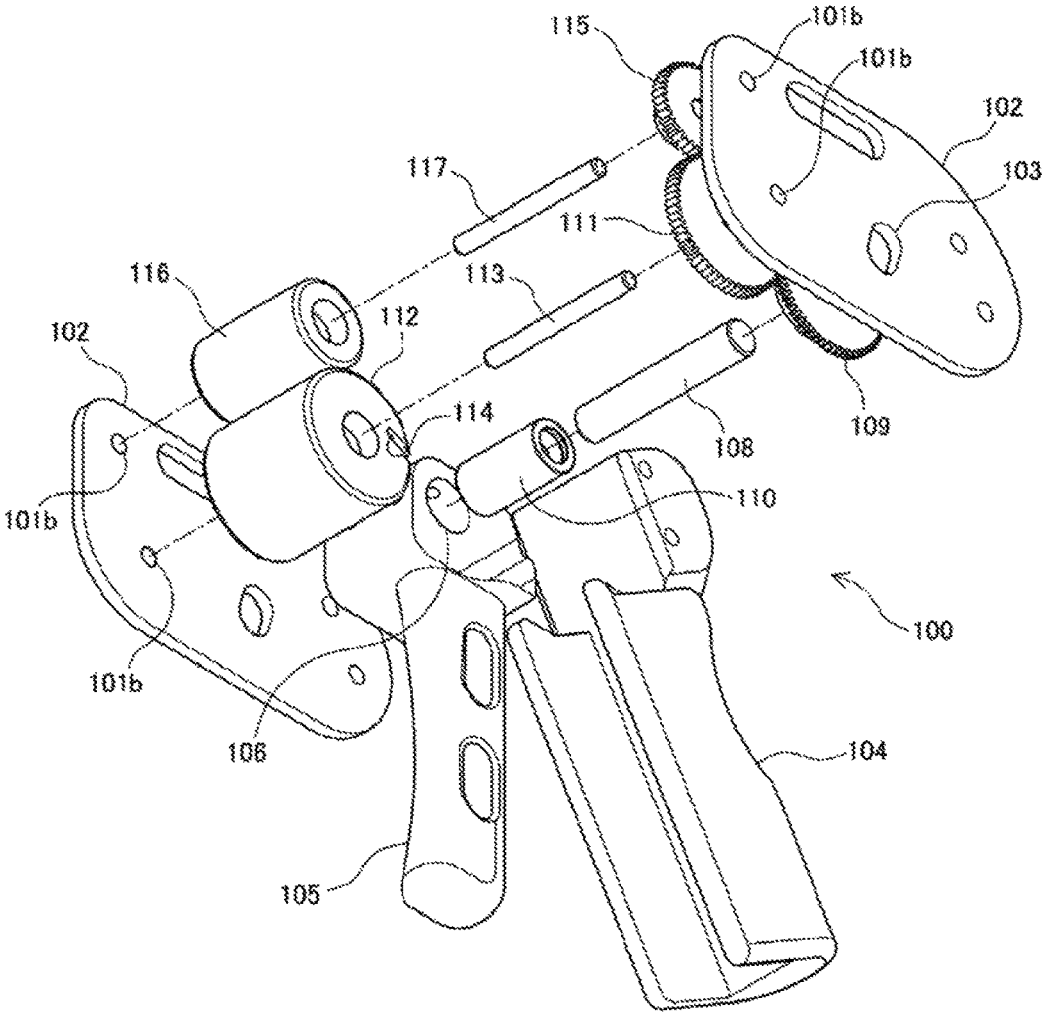
FIG. 7 is an exploded perspective view of the tube squeeze device of FIG. 1.
Figure 8:
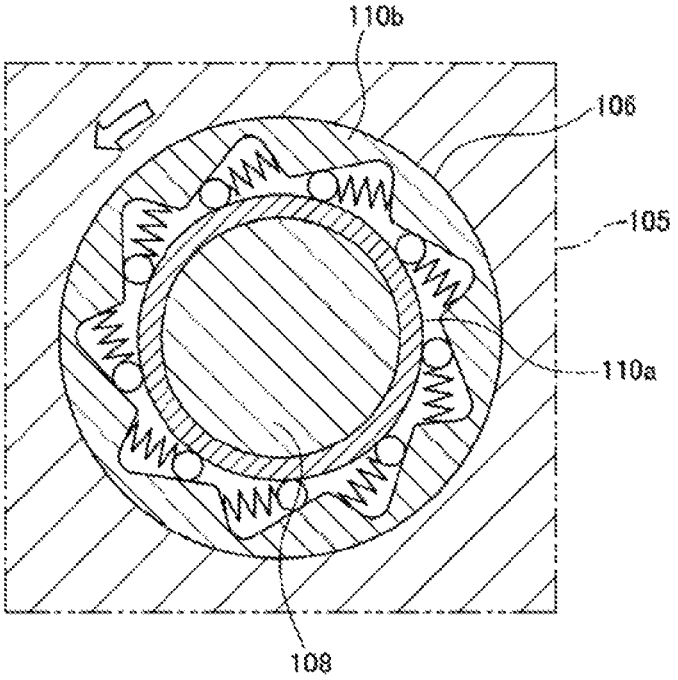
FIG. 8 is a schematic view of the configuration of the one-way clutch of the tube squeeze device of FIG. 1.
Figure 8:
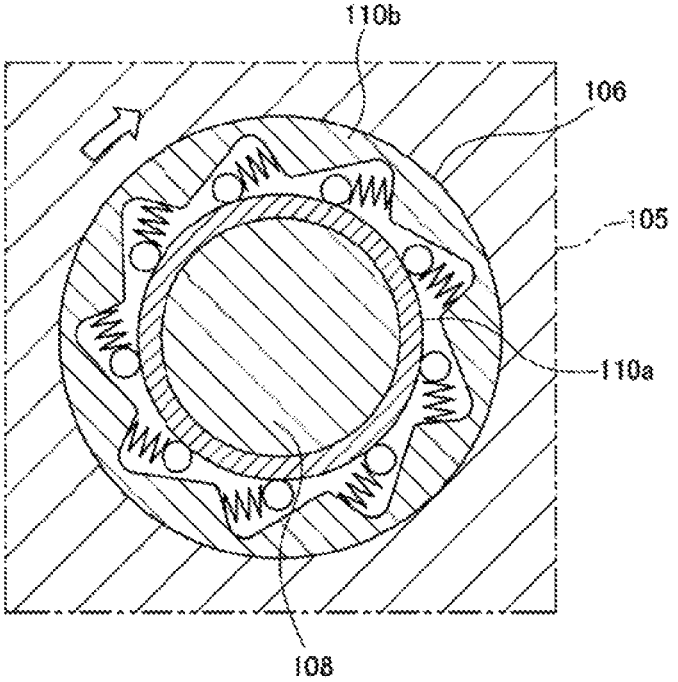

The internal structure of the tube squeeze device 100 according to the present embodiment is described below with reference to FIGS. 3 to 8. FIG. 3 is a perspective view of the tube squeeze device 100 where the body 101 (side plate 102) is depicted as transparent in order to show the internal structure. FIG. 4 is a cross-sectional view taken along line A-A of FIG. 2 (*b*). FIG. 5 is a cross-sectional view taken along line B-B of FIG. 2 (*b*). FIG. 6 is a partial enlarged view of FIG. 4. FIG. 7 is an exploded perspective view of the tube squeeze device 100. FIG. 8 is a schematic view of the one-way clutch 110.

As shown in FIGS. 3 to 7, the tube squeeze device 100 according to the present embodiment includes a first gear 109 axially supported by the body 101 via a rotation shaft 108 so as to be capable of rotating; a one-way clutch 110 for linking the operation lever 105 and the first gear 109; a second gear 111 axially supported by the body 101 so as to be capable of rotating and so as to mesh with the first gear 109; a main roller 112 joined with the second gear 111 so as to rotate synchronously with the second gear 111; a third gear 115 axially supported by the body 101 so as to be capable of rotating and so as to mesh with the second gear 111 (and so as to be separate from the first gear 109); and an auxiliary roller 116 that follows the rotation of the main roller 112 and squeezes a tube T together with the main roller 112.

The rotation shaft 108 passes through the elongate holes 103 and is supported by the pair of side plates 102, and passes through a connection hole 106 (see FIG. 7) formed in the vicinity of the base end of the operation lever 105. The rotation shaft 108 is movably inserted in the elongate holes 103, and can float in the longitudinal direction of the elongate holes 103. The first gear 109 is disposed on the side of one of the side plates 102, and is fastened to one end of the rotation shaft 108. As such, the first gear 109 rotates synchronously with the rotation shaft 108. The one-way clutch 110 is further attached to the rotation shaft 108.

A general one-way clutch mechanism consisting of an inner cylinder 119*a* and an outer cylinder 110*b* as shown in FIG. 8 may be employed as the one-way clutch 110. In the one-way clutch 110, the inner cylinder 110*a* and the outer cylinder 110*b* are locked such that they rotate together when the inner cylinder 110*a* rotates in one direction. (See FIG. 8 (*a*).) On the other hand, when the inner cylinder 110*a* rotates in the other direction, the inner cylinder 110*a* idles relative to the outer cylinder 110*b*. (See FIG. 8 (*b*).) The present embodiment employs a cam clutch as the one-way clutch, but a sprag clutch may also be employed as the one-way clutch.

In the present embodiment, the inner circumferential surface of the inner cylinder 110*a* of the one-way clutch 110 is fixed to the outer surface of the rotation shaft 108, and the outer circumferential surface of the outer cylinder 110*b* of the one-way clutch is fixed to the operation lever 105 within the connection hole 106. The one-way clutch 110 thus couples the operation lever 105 to the first gear 109 via the rotation shaft 108 such that the first gear 109 is caused to rotate in the forward direction (the clockwise direction in FIG. 4) when the operation lever 105 is turned in the forward direction (rearward), and the first gear 109 is not caused to rotate when the operation lever 105 is turned in the reverse direction (forward). In other words, the direction in which relative rotation of the operation lever 105 and the first gear 109 is possible is restricted to one direction, whereby turning of the operation lever 105 relative to the first gear 109 in the forward direction is locked (clutched), and rotation of the first gear 109 relative to the operation lever 105 in the reverse direction is locked. Therefore, even if the operation lever 105 is repeatedly turned in both directions, the first gear 109 only rotates in the forward direction (the clockwise direction in FIG. 4), and rotation of the first gear 109 in the reverse direction is restricted.

The second gear 111 is disposed on one side of the side plates 102, and is positioned adjacent to the first gear 109 so as to mesh with the first gear 109. (See FIG. 4.) As such, when the first gear 109 rotates in the clockwise direction of FIG. 4 due to the turning of the operation lever 105, the second gear 111 follows the first gear 109 and rotates in the counter-clockwise direction of FIG. 4. The second gear 111 is coupled to one end of the cylindrical main roller 112 that extends between the pair of side plates 102. In other words, the second gear 111 and the main roller 112 rotate synchronously. A main roller shaft 113 passes through the second gear 111 and the main roller 112. In the present embodiment, the main roller shaft 113 is integrally coupled to the second gear 111 and the main roller 112, but the present invention is not so limited. The main roller shaft 113 is rotatably supported between the pair of side plates 102 via support holes 101*b*.

As shown in FIG. 5, the outer surface of the main roller 112 is provided with a tube holding groove 114. The tube holding groove 14 is a slit that extends along the axial direction of the main roller 112, and is configured to be capable of holding a tube bottom T1 of a tube T at the outer surface of the main roller 112. As seen from the side, the tube holding groove 114 extends diagonally from a position offset from the radial direction of the main roller 112, such that the tube holding groove 114 is open diagonally forward and upward when the tube holding groove 114 has moved near the foremost surface of the tube squeeze device 100 due to the rotation of the main roller 112. More specifically, when the opening of the tube holding groove 114 is located near the foremost surface, the tube holding groove 114 extends diagonally downward from the radial direction (horizontal direction) of the main roller 112. Therefore, when the tube bottom T1 of the tube T is inserted from the front of the tube squeeze device 100, the tube T will not easily fall down, since the tube bottom T1 is facing diagonally downward.

The third gear 115 is disposed on one side of the side plates 102, and is disposed adjacent to the second gear 111 so as to be separate from the first gear 109 and to mesh with the second gear 111. (See FIG. 4.) In other words, when the second gear 111 rotates in the counter-clockwise direction of FIG. 4 due to the turning of the operation lever 105, the third gear 115 follows the second gear 111 and rotates in the clockwise direction of FIG. 4. The third gear 115 is coupled to one end of the cylindrical auxiliary roller 116 that extends between the pair of side plates 102. In other words, the third gear 115 and the auxiliary roller 116 rotate synchronously. An auxiliary roller shaft 117 passes through the third gear 115 and the auxiliary roller 116. In the present embodiment, the auxiliary roller shaft 117 is integrally coupled to the third gear 115 and the auxiliary roller 116, but the present invention is not so limited. The auxiliary roller shaft 117 is rotatably supported between the pair of side plates 102 via support holes 101*c*.

The auxiliary roller 116 has a smaller diameter than the main roller 112 and is disposed diagonally forward and above the main roller 112, and a small gap is formed between the main roller 112 and the auxiliary roller 116 so that the body T2 of the tube T is able to pass through between the main roller 112 and the auxiliary roller 116. This gap corresponds to the thickness of the tube body T2 after the tube has been squeezed. Thus, when the main roller 112 rotates in the forward direction (the clockwise direction in FIG. 5) due to the turning in the forward direction of the operation lever 105, the meshing of the second and third gears 111, 115 causes a subsequent rotation (in the counter-clockwise direction in FIG. 5) of the auxiliary roller 116, whereby the tube T can be introduced between the main roller 112 and the auxiliary roller 116 through the gap at the front surface of the tube squeeze device 100. In the present embodiment, the quantity of rotation of the main roller 112 is set to be 30 degrees when the operation lever 105 is turned across its possible range of movement. However, by changing the number of teeth or size of the gears, the quantity of rotation of the rollers can be set as desired.

As shown in FIG. 6, in the present embodiment, a straight line which connects the rotation shaft 108 and the main roller shaft 13 in a state where the first gear 109 and the second gear 111 are meshing with each other is defined as L. In addition, the longitudinal axis of the elongate hole 103 through which the rotation shaft 108 passes is defined as M. In the present embodiment, the straight line L extends in a horizontal direction relative to the side plates 102. The elongate hole 103 extends diagonally backward and upward from the straight line L, and the longitudinal axis M of the elongate hole 103 is inclined relative to the straight line L by an angle of inclination α. In the present embodiment, the angle of inclination α is about 75 degrees. However, the present invention is not so limited.

Referring to FIG. 6, the rotation shaft 108 is axially supported by the side plates 102 so as to be capable of moving within the elongate hole 103 along the longitudinal axis M. The rotation shaft 108 is indirectly urged toward the forward side within the elongate hole 103 via the spring 107 that urges the operation lever 105 forward. When the rotation shaft 108 is positioned at the forward end (meshing position) of the elongate hole 103, the first gear 109 and the second gear 111 are in a mutually meshing relationship. Normally when the operation lever 105 is turned in the forward direction, the rotation shaft 108 rotates in the meshing position, whereby both the first gear 109 and the second gear 111 are able to rotate. On the other hand, when rotation in the forward direction of the main roller 12 is restricted, the second gear 111 meshing with the third gear 115 also becomes unable to rotate. If the operation lever is further turned in the forward direction in this state, the rotation shaft 108 moves backward within the elongate hole 103, such that the first gear 109 (rotation shaft 108) and the second gear 111 (main roller shaft 113) separate from each other. (See the phantom line in FIG. 6.) As a result, meshing of the first gear 109 and the second gear 111 is released, and the first gear 109 idles together with the turning of the operation lever 105. In other words, when further force is applied by the operation lever 105 in a state where rotation of the first gear 109 is restricted, this force causes the rotation shaft 108 to move away from the meshing position within the elongate hole 103 instead of causing the rotation shaft 108 to rotate. The rotation shaft 108 consequently moves along the longitudinal axis M within the elongate hole 103. Then, when the rotation shaft 108 is positioned at the rear end (idle position) of the elongate hole 103, the first gear 109 and the second gear 111 are in an idle relationship separate from each other. As such, the rotation shaft 108 is capable of moving along the longitudinal axis M from the meshing position to the idle position of the elongate hole 103 depending on the state of the feeding of the tube between the rollers 112, 116.

In the present invention, it is preferable that the angle of inclination α be in the range of 45 to 85 degrees in order to ensure that the meshing position of the rotation shaft 108 is maintained during rotation of the main roller 112, and that the rotation shaft 108 is moved from the meshing position to the idle position in the elongate hole 103 when rotation of the main roller 112 is restricted. If the angle of inclination α exceeds 85 degrees and approaches 90 degrees, the first gear 109 will slide almost vertically upward relative to the second gear 111, making it difficult to release the first gear 109 and the second gear 111 from their meshing, thereby severely complicating movement of the rotation shaft 108 within the elongate hole 103. Conversely, if the angle of inclination α is less than 45, the rotation shaft 108 can very easily move within the elongate hole 103, leading to the risk that merely a small force applied in the reverse direction to the main roller 112 will release the meshing of the first gear 109 and the second gear 111, making it impossible to squeeze the tube T in a stable manner. Generally, the bigger the angle of inclination α, the greater the force (applied to the roller in the reverse direction) required to cause the rotation shaft 108 to move from the meshing position to the idle position. In the present embodiment, the angle of inclination α is set to 75 degrees, as a result of trial-and-error to find the optimal balance.

The tube squeeze device 100 according to the present embodiment is constructed by assembling the components described above between the pair of side plates 102, as shown in FIG. 7.

Next, a method for squeezing the tube T using the tube squeeze device 100 according to the present embodiment will be described with reference to FIGS. 9 to 11.

Figure 9:
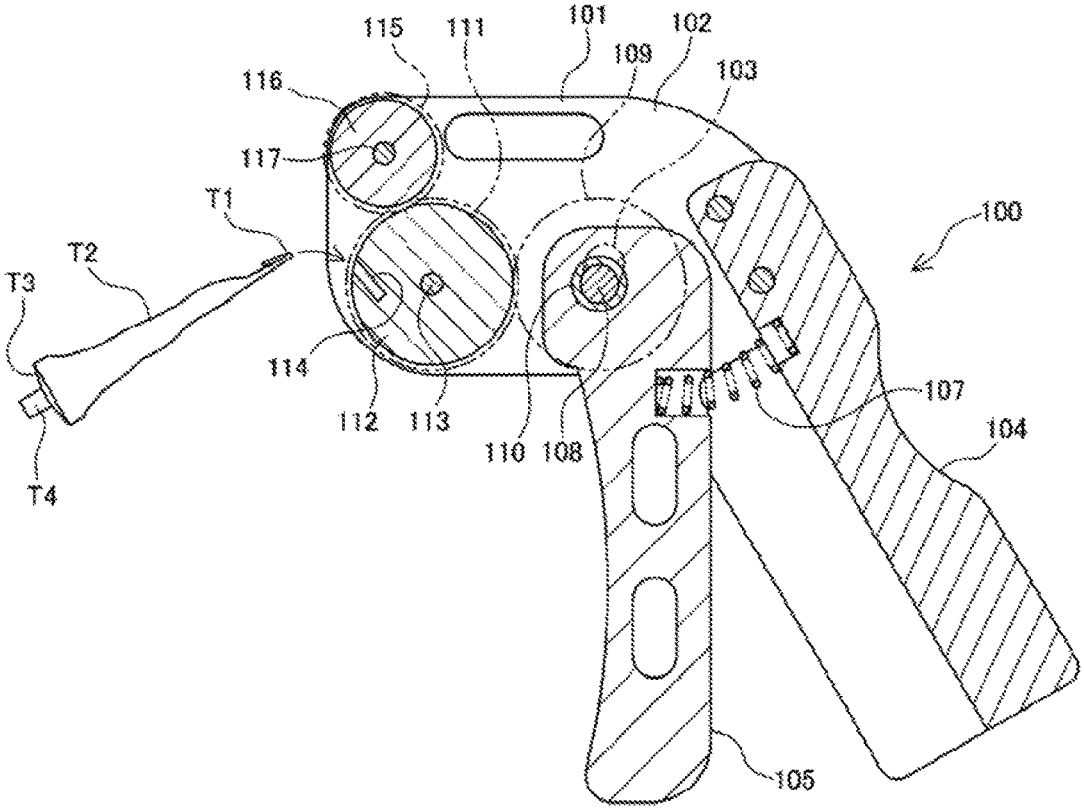
FIG. 9 is a schematic view of a method step for squeezing a tube with the tube squeeze device according to the present embodiment.
Figure 10:
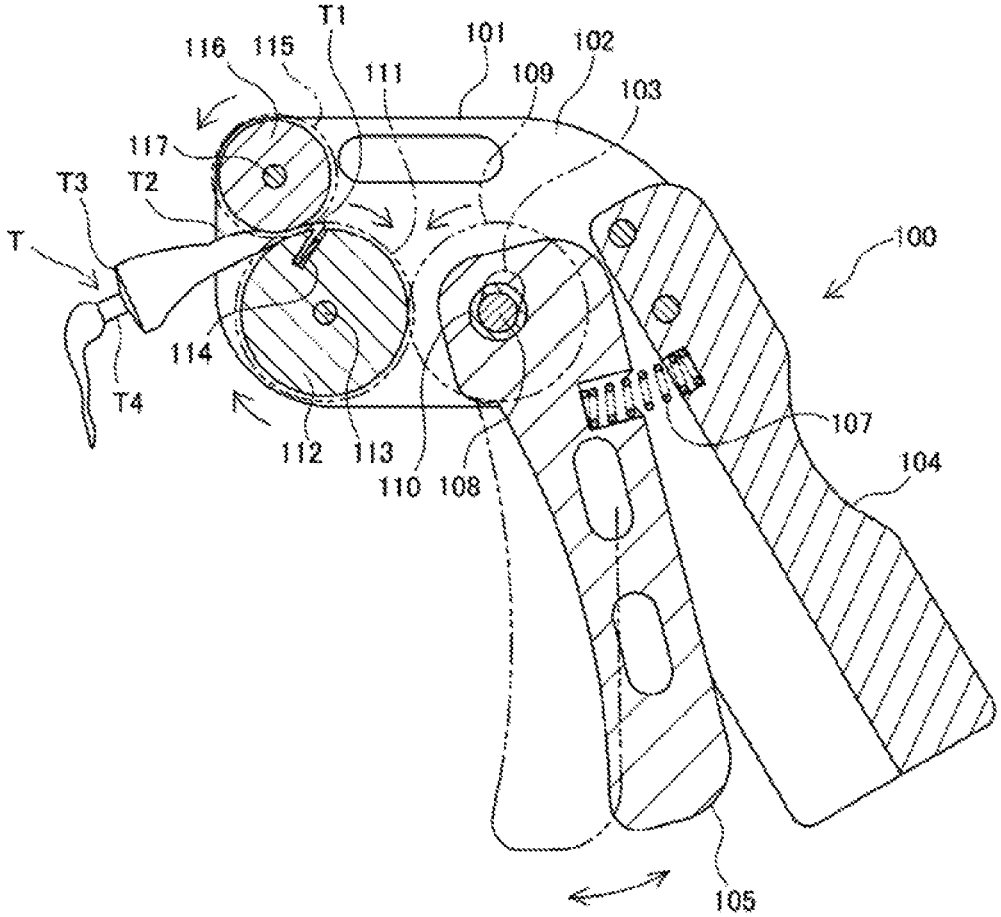
FIG. 10 is a schematic view of a method step for squeezing a tube with the tube squeeze device according to the present embodiment.

First, as shown in FIG. 9, the operation lever 105 is turned to cause the main roller 112 to rotate in the forward direction (clockwise), so that the tube holding groove 114 is positioned at the front surface of the tube squeeze device 100. More specifically, a user holds the handle 104 while applying a force to the operation lever 105 to counter the urging of the spring 107 and turn the operation lever 105 in the forward direction (rearward). The main roller 112 and the auxiliary roller 116 then rotate by a predetermined quantity in the forward direction. When the force is removed from the operation lever 105, the urging force of the spring 107 causes the operation lever 105 to turn in the reverse direction (forward) back to its initial position. When the operation lever 105 turns in the reverse direction, the one-way clutch 110 does not transmit the driving force, and the rollers 112, 116 thus do not rotate. The user can then repeat the turning operation of the operation lever 105 in the forward and reverse directions to cause the main roller 112 to rotate a desired distance (quantity of rotation). The operation lever 105 may be turned across its entire range of movement, or only a portion thereof. After the tube holding groove 114 is arranged at the front surface of the tube squeeze device 100, the tube bottom T1 is inserted into the tube holding groove 114, such that the tube T is held at the outer surface of the main roller 112.

Next, with the tube T held at the outer surface of the main roller 112, the operation lever 105 is turned in both directions one or more times in the same way. This turning operation allows the tube bottom T1 to enter the gap between the main roller 112 and the auxiliary roller 116. Further, by repeating this turning operation of the operation lever 105 in both directions, the tube T can be fed in the forward direction (rearward) while the tube body T2 is squeezed by the main roller 112 and the auxiliary roller 116 as shown in FIG. 10, such that part of the contents of the tube T can be squeezed out from the tube head T4.

Figure 11:
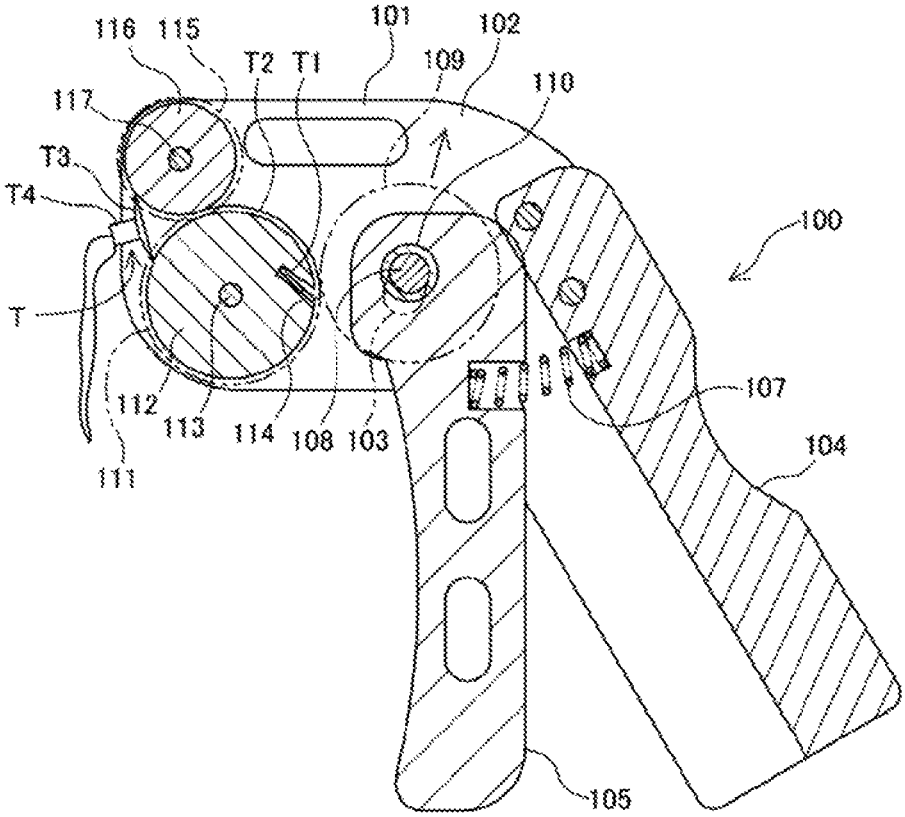
FIG. 11 is a schematic view of a method step for squeezing a tube with the tube squeeze device according to the present embodiment.

By further repetition of the turning operation of the operation lever 105, the tube T is fed forward until the tube shoulder T3 comes into contact with the main roller 112 and the auxiliary roller 116 as shown in FIG. 11. In this way, the contents of the tube T can be almost completely squeezed out. At this time, the tube shoulder T3 is wedged in the gap between the rollers 112, 116, such that rotation of the main roller 112 and the auxiliary roller 116 is restricted by the tube shoulder T3. In this state of restricted rotation, operating the operation lever 105, as described above, causes the rotation shaft 108 to move within the elongate hole 103, so that the operation lever 105 idles.

Finally, after the contents of the tube T have been squeezed out, the tube T can be removed from the tube squeeze device 100 by pulling the tube T out in the reverse direction. At this time, although the first gear 109 does not rotate in the reverse direction, the second gear 111 rotates in the reverse direction and pushes the rotation shaft 108 into the idle position in the elongate hole 103. It is thus possible to rotate the second gear 111 (main roller 112 and auxiliary roller 116) in the reverse direction and remove the tube T from the front surface of the tube squeeze device 100 because the rotation shaft 108 moves within the elongate hole 103 to release the meshing of the first gear 109 and the second gear 111. In this way, the user is able to easily squeeze out the contents of the tube T by repeating the simple operation of turning the operation lever in both directions while holding the handle 104.

The operational effects of the tube squeeze device 100 according to an embodiment of the present invention are described below.

According to the tube squeeze device 100 of the present embodiment, repeated turning operations of the operation lever 105 in both directions causes the first gear 109 to rotate only in the forward direction due to the one-way clutch 110, whereby the main roller 112 only rotates in one direction, such that the tube T can be fed between the main roller 112 and the auxiliary roller 116 without being retracted. The distance through which the tube T is fed by the main roller 112 and auxiliary roller 116 is determined by the distance and number of times the operation lever 105 turns in the forward direction. For example, in a case where a long tube T is being squeezed, multiple reciprocal movements of the operation lever 105 ensure that all of the tube contents can be squeezed out. The tube squeeze device 100 according to the present invention can thus be of a compact configuration, regardless of the length of the tube T. Meanwhile, it is possible to make fine adjustments to the quantity of tube contents to be squeezed out by stopping turning of the operation lever 105 at a predetermined position within the turning range, so as to define the distance through which the tube T is fed. In other words, the simple action of a user holding the handle 104 and turning the operation lever 105 in both directions allows for a desired quantity of contents to be squeezed out regardless of the length of the tube T. Accordingly, the tube squeeze device 100 according to the present invention may be of a compact configuration, and is easy to operate.

Further, according to the tube squeeze device 100 of the present embodiment, the first gear 109 idles relative to the second gear 111 when the operation lever 105 is turned in the forward direction in a state where forward rotation of the main roller 112 is restricted, due to the rotation shaft 108 moving from the meshing position to the idle position in the elongate hole 103, whereby rotation of the main roller 112 can be stopped. For example, when the tube T has been fed between the main roller 112 and the auxiliary roller 116 up to the tube shoulder T3 and the tube T is locked by the main and auxiliary rollers 112, 116 (in other words when the tube T is wedged between the rollers 112, 116), any further rotation of the rollers 112, 116 caused by a forward turning operation of the operation lever 105 is prevented. As such, even if the operation lever 105 is operated excessively, the idling of the operation lever 105 itself can prevent the first and second gears 109, 111 and the main roller 112 from forcibly rotating and subjecting the components to excessive stress or damaging the tube T.

[Variants]

The present invention is not limited to the aforementioned embodiment, but may take a variety of embodiments and variants. A plurality of variants of the present invention are described below.

(1) In the aforementioned embodiment, the auxiliary roller 116 follows the main roller 112 via the third gear 115, but this third gear 115 may be omitted. For example, the auxiliary roller shaft may be axially supported so as to be movable, and the auxiliary roller shaft urged toward the main roller shaft by a flexible member, such that the auxiliary roller is made to follow the main roller by direct or indirect pressing contact between the main roller and the auxiliary roller.

(2) In the aforementioned embodiment, the first gear 109 and the rotation shaft 108 are integrally coupled. However, the present invention is not so limited. For example, the first gear and the rotation shaft may be configured to be relatively movable, such that the first gear rotates about the periphery of the rotation shaft. In this case, the one-way clutch may directly couple the first gear to the operation lever, such that a forward turning of the operation lever causes forward rotation of the first gear, while a reverse turning of the operation lever does not cause rotation of the first gear.

(3) In the aforementioned embodiment, the main roller 112 and the main roller shaft 113 are integrally coupled. However, the present invention is not so limited. For example, the main roller and its central axis may be separate components, whereby the main roller rotates about the central axis.

(4) The present invention is not limited to the shape according to the aforementioned embodiment, but may assume a variety of shapes. For instance, the tube squeeze device 100 according to the aforementioned embodiment takes a shape resembling that of a handgun, but a variety of designs are applicable, so long as they are within the technical scope of the present invention.

The present invention is not limited to the embodiments and variants described above, but may be practiced in a variety of aspects within the technical scope of the invention.

DESCRIPTION OF THE REFERENCE NUMERAL

100 Tube squeeze device
101 Body
101*a* Hanging hole
101*b* Support hole
101*c* Support hole
102 Side plate
103 Elongate hole
104 Handle
105 Operation lever
106 Connection hole
107 Spring
108 Rotation shaft
109 First gear
110 One-way clutch
111 Second gear
112 Main roller
113 Main roller shaft
114 Tube holding groove

115 Third gear
116 Auxiliary roller
117 Auxiliary roller shaft
T Tube
T1 Bottom
T2 Body
T3 Shoulder
T4 Head
L Straight line connecting the rotation shaft and the main roller shaft
M Longitudinal axis of the elongate hole

The invention claimed is:

1. A tube squeeze device for squeezing contents out of a tube, the tube squeeze device comprising:

a body;

a handle extending from the body;

an operation lever axially supported by the body via a rotation shaft such that the operation lever is disposed facing the handle, the operation lever being capable of turning in two directions within a prescribed range of movement;

a first gear axially supported by the body via the rotation shaft so as to be capable of rotating;

a one-way clutch for linking the operation lever and the first gear such that the first gear is caused to rotate in a forward direction when the operation lever is turned in the forward direction and such that the first gear is not caused to rotate when the operation lever is turned in a reverse direction;

a second gear axially supported by the body so as to be capable of rotating and so as to mesh with the first gear;

a main roller joined with the second gear so as to rotate synchronously with the second gear; and an auxiliary roller that follows the rotation of the main roller and squeezes the tube together with the main roller, wherein the rotation shaft is movably supported by an elongate hole provided in the body, whereby the rotation shaft is movable along a longitudinal axis of the elongate hole from a meshing position in which the first gear and the second gear mesh with each other to an idle position in which the first gear and the second gear are separate from each other, and wherein when the operation lever turns in the forward direction in a state where the rotation of the main roller in the forward direction is restricted, the rotation shaft moves from the meshing position to the idle position, such that the first gear idles relative to the second gear.

2. The tube squeeze device according to claim 1, wherein the main roller and the auxiliary roller are disposed at a front end of the body, the handle extends downward at a rear end of the body, and the operation lever turns in the forward direction so as to approach the handle.

3. The tube squeeze device according to claim 2, wherein the longitudinal axis of the elongate hole is inclined diagonally backward and upward at a prescribed angle of inclination with respect to a straight line connecting the rotation shaft and a central axis of the second gear in the meshing position, wherein the angle of inclination is within a range of 45 to 85 degrees.

4. The tube squeeze device according to claim 3, wherein the angle of inclination is 75 degrees.

5. The tube squeeze device according to claim 2, wherein a tube holding groove for insertion of a bottom of the tube is formed in an outer surface of the main roller, the tube holding groove being open diagonally forward and upward when the tube holding groove has moved to a foremost surface.

6. The tube squeeze device according to claim 1, further comprising a flexible body that urges the operation lever away from the handle, wherein the rotation shaft is indirectly urged to the meshing position by the flexible body.

7. The tube squeeze device according to claim 1, further comprising a third gear axially supported by the body so as to be capable of rotating and so as to mesh with the second gear, wherein the auxiliary roller is joined to the third gear so as to rotate synchronously with the third gear.

* * * * *